US012747884B2

(12) United States Patent
Sato

(10) Patent No.: US 12,747,884 B2
(45) Date of Patent: Sep. 29, 2026

(54) INFORMATION PROCESSING DEVICE, AIR CONDITIONING SYSTEM, AND PROGRAM

(71) Applicant: DAIKIN INDUSTRIES, LTD., Osaka (JP)

(72) Inventor: Daisuke Sato, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 454 days.

(21) Appl. No.: 18/283,627

(22) PCT Filed: Feb. 4, 2022

(86) PCT No.: PCT/JP2022/004377
§ 371 (c)(1),
(2) Date: Sep. 22, 2023

(87) PCT Pub. No.: WO2022/201896
PCT Pub. Date: Sep. 29, 2022

(65) Prior Publication Data

US 2024/0159417 A1 May 16, 2024

(30) Foreign Application Priority Data

Mar. 25, 2021 (JP) ..... 2021-052073

(51) Int. Cl.
*F24F 11/64* (2018.01)
*F24F 11/523* (2018.01)
(Continued)

(52) U.S. Cl.
CPC ..... *F24F 11/64* (2018.01); *F24F 11/523* (2018.01); *F24F 11/61* (2018.01); *F24F 11/80* (2018.01); *F24F 2110/10* (2018.01)

(58) Field of Classification Search
CPC ..... F24F 11/52; F24F 11/523; F24F 11/56; F24F 11/58; F24F 11/61; F24F 11/64;
(Continued)

(56) References Cited

U.S. PATENT DOCUMENTS 6,283,380 B1 9/2001 Nakanishi et al.
2004/0260490 A1* 12/2004 Matsubayashi ..... H02J 3/003 702/60

(Continued)

FOREIGN PATENT DOCUMENTS

JP 1-252850 A 10/1989
JP 8-121849 A 5/1996

(Continued)

OTHER PUBLICATIONS

International Search Report, issued in PCT/JP2022/004377, PCT/ISA/210, dated Apr. 26, 2022.

(Continued)

*Primary Examiner* — Chun Cao
(74) *Attorney, Agent, or Firm* — Birch, Stewart, Kolasch & Birch, LLP

(57) ABSTRACT

[Problem] To allow a user to know a range of an adjustable environment in a predetermined space adjusted by an air conditioner and a spatial range adjustable to a predetermined environment.

[Solution] An information processing device includes a device information acquisition unit that acquires device information on an air conditioner, a space information acquisition unit that acquires space information on a target space where the air conditioner is installed, an environment information acquisition unit that acquires environment information including at least a temperature at a measurement position in the target space, an estimation unit that estimates an environment including at least a temperature at (Continued)

a specific position different from the measurement position in the target space based on the device information, the space information, and the environment information, and a presentation unit that presents, based on estimation by the estimation unit, a range of an environment including a temperature adjustable by the air conditioner at the specific position and/or a spatial range in the target space adjustable to a predetermined environment including a temperature by the air conditioner.

13 Claims, 10 Drawing Sheets

(51) Int. Cl.
*F24F 11/61* (2018.01)
*F24F 11/80* (2018.01)
*F24F 110/10* (2018.01)

(58) Field of Classification Search
CPC .... F24F 11/80; F24F 2110/10; F24F 2140/00; B67D 2210/0001; C08L 17/00; C08L 23/0853; C08L 23/16; C08L 33/00; C08L 75/04; C09D 1/04; C09D 133/00; C09D 175/04; C09D 5/18; C09D 7/61; E01C 13/045; F25C 2400/12; F25C 5/18; F25C 5/20
USPC ..... 700/83
See application file for complete search history.

(56) References Cited

U.S. PATENT DOCUMENTS

| | | | | |
|---|---|---|---|---|
| 2011/0257795 | A1* | 10/2011 | Narayanamurthy .. | F24F 5/0046 700/277 |
| 2013/0268126 | A1* | 10/2013 | Iwami ..... | F24F 11/52 700/276 |
| 2015/0012142 | A1 | 1/2015 | Koga | |
| 2017/0045253 | A1* | 2/2017 | Dempsey ..... | F24F 11/49 |
| 2018/0195755 | A1 | 7/2018 | Nishida et al. | |
| 2019/0360716 | A1 | 11/2019 | Ozaki | |
| 2021/0318016 | A1* | 10/2021 | Murakami ..... | G05B 15/02 |
| 2021/0396587 | A1* | 12/2021 | Oyaizu ..... | H04N 23/52 |
| 2022/0333809 | A1* | 10/2022 | Higuchi ..... | G06F 3/0481 |

FOREIGN PATENT DOCUMENTS

| | | | |
|---|---|---|---|
| JP | 2008-128582 | A | 6/2008 |
| JP | 2011-257071 | A | 12/2011 |
| JP | 2015-14422 | A | 1/2015 |
| JP | 2015-148410 | A | 8/2015 |
| WO | WO 2018/179731 | A1 | 10/2018 |
| WO | WO 2019/224916 | A1 | 11/2019 |

OTHER PUBLICATIONS

Extended European Search Report for European Application No. 22774697.1, dated Aug. 13, 2024.

* cited by examiner

INFORMATION PROCESSING DEVICE, AIR CONDITIONING SYSTEM, AND PROGRAM

TECHNICAL FIELD

The present disclosure relates to an information processing device, an air conditioning system, and a program.

BACKGROUND ART

For example, PTL 1 describes an air conditioner in which an air conditioner main body includes a reception unit that receives data from a remote controller and a control unit that controls an operation based on received data, and the control unit determines a recommended temperature and/or a recommended humidity as recommendation data that is recommended for an indoor environment based on an outdoor temperature, an indoor temperature, a temperature of an indoor heat exchanger, and a number of rotations of a compressor.

CITATION LIST

Patent Literature

PTL 1: Japanese Unexamined Patent Application Publication No. 2008-128582

SUMMARY OF INVENTION

Technical Problem

Here, when it is possible to know the range of an environment such as an adjustable temperature in a predetermined space adjusted by the air conditioner or a spatial range adjustable to a predetermined environment, for example, a user may refer to it when selecting a place where the user is present or makes settings for the air conditioner.

An object of the present disclosure is to allow a user to know the range of an adjustable environment in a predetermined space adjusted by an air conditioner and the spatial range adjustable to a predetermined environment.

Solution to Problem

An information processing device according to the present disclosure includes a device information acquisition unit that acquires device information on an air conditioner, a space information acquisition unit that acquires space information on a target space where the air conditioner is installed, an environment information acquisition unit that acquires environment information including at least a temperature at a measurement position in the target space, an estimation unit that estimates an environment including at least a temperature at a specific position different from the measurement position in the target space based on the device information, the space information, and the environment information, and a presentation unit that presents, based on estimation by the estimation unit, a range of an environment including a temperature adjustable by the air conditioner at the specific position and/or a spatial range in the target space adjustable to a predetermined environment including a temperature by the air conditioner. In this case, the user may know the range of adjustable environment and the spatial range in the predetermined space adjusted by the air conditioner.

Further, the space information acquisition unit acquires the space information including information on a size of the target space and information on an arrangement of the air conditioner in the target space. In this case, it is possible to perform highly accurate estimation that reflects the size of the target space and the arrangement of the air conditioner in the target space.

Further, the space information acquisition unit acquires the space information including information on an object that is different from the air conditioner and that affects a temperature environment in the target space. In this case, it is possible to perform highly accurate estimation that reflects the information on the object that affects the environment.

Further, the presentation unit presents information in a vertical direction and/or a horizontal direction of the target space. In this case, it is possible to present, to the user, the range of an environment or the spatial range that is different individually in the vertical direction and/or the horizontal direction in the target space.

Further, the presentation unit displays information on a range of an environment including at least a temperature at the specific position adjustable by the air conditioner so as to be superimposed on an image representing the target space. In this case, the user may more easily know the range of the environment.

Further, the presentation unit presents a range of the environment at a plurality of the specific positions. In this case, for example, compared to a case where the range of the environment at a single specific position is presented, the user may know the information on the adjustable range of the environment in the target space in detail.

Furthermore, the presentation unit presents time information about a time it takes for the environment at the specific position to become a predetermined environment. In this case, the user may know the time it takes to become the predetermined environment.

Furthermore, while maintaining an environment at a first specific position among the specific positions, the presentation unit presents a range of an environment adjustable at a second specific position different from the first specific position. In this case, for example, while maintaining the set temperature desired by the user at the first specific position, the range of the environment that may be set by another user at the second specific position may be indicated.

Furthermore, according to another aspect, an air conditioning system according to the present disclosure includes an air conditioner that adjusts at least a temperature in a target space, a device information acquisition unit that acquires device information on the air conditioner, a space information acquisition unit that acquires space information on the target space, an environment information acquisition unit that acquires environment information including at least a temperature at a measurement position in the target space, an estimation unit that estimates an environment including at least a temperature at a specific position different from the measurement position in the target space based on the device information, the space information, and the environment information, a presentation unit that presents, based on estimation by the estimation unit, a range of an environment including a temperature adjustable by the air conditioner at the specific position and/or a spatial range in the target space adjustable to a predetermined environment including a temperature by the air conditioner, a setting reception unit that receives, from a user, setting information on an environment including a temperature at a predetermined position in the target space, and a control information generation unit that generates control information for controlling the air conditioner in accordance with the setting information received by the setting reception unit. In this case, the user may know the range of adjustable environment and the spatial range in the predetermined space adjusted by the air conditioner.

Moreover, according to another aspect, a program according to the present disclosure performs a function of acquiring device information on an air conditioner, a function of acquiring space information on a target space in which the air conditioner is installed, a function of acquiring environment information including at least a temperature at a measurement position in the target space, a function of estimating an environment including at least a temperature at a specific position different from the measurement position in the target space based on the device information, the space information, and the environment information, and a function of presenting, based on the estimating, a range of an environment including a temperature adjustable by the air conditioner at the specific position and/or a spatial range in the target space adjustable to a predetermined environment including a temperature by the air conditioner. In this case, the user may know the range of adjustable environment and the spatial range in the predetermined space adjusted by the air conditioner.

DESCRIPTION OF EMBODIMENTS

An embodiment of the present disclosure will be described below in detail with reference to the accompanying drawings.

Figure 1:
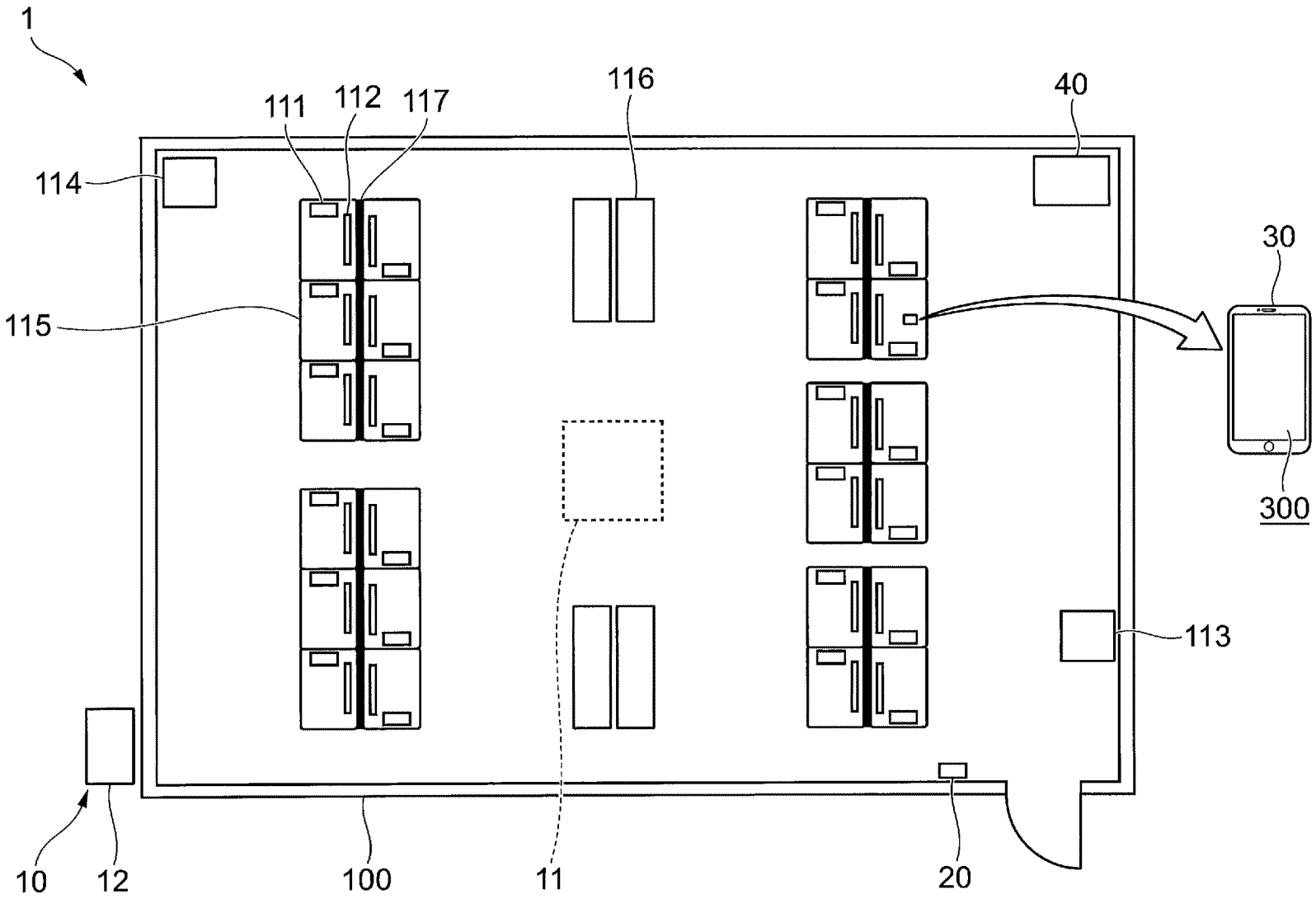
FIG. 1 is a schematic view of an air conditioning system according to the present embodiment.

FIG. 1 is a schematic view of an air conditioning system 1 according to the present embodiment.

As illustrated in FIG. 1, the air conditioning system 1 includes an air conditioner 10 that adjusts an air environment such as an air temperature in a target space 100, an environment sensor 20 that detects environment information of air quality such as a temperature and a humidity in the target space 100, an information terminal device 30 used by a user, and a server device 40 that outputs predetermined information based on various types of information such as the environment information.

In the air conditioning system 1 according to the present embodiment, the individual devices may communicate information with each other via a network. The network is not limited as long as it is a communication network used for data communications between the individual devices and may be, for example, a LAN (Local Area Network), a WAN (Wide Area Network), or the Internet. The communication line used for data communications may be either wired or wireless, or both of them may be used.

In the description according to the present embodiment, an example of an office space is used as the target space 100. Furthermore, the target space 100 is not limited to an example of the office space and may be other spaces as long as it is the target space for the adjustment of an air environment by the air conditioner 10.

Furthermore, as illustrated in FIG. 1, the target space 100 is provided with an indoor unit 11 of the air conditioner 10, the environment sensor 20, the information terminal device 30, and the server device 40. Further, the target space 100 is provided with heat generating furniture and fixtures such as a personal computer 111, a monitor 112, a printer 113, and a server rack 114, which generate heat, and non-heat generating furniture and fixtures such as a desk 115, a bookshelf 116, and a partition 117, which affect the flow of air.

Moreover, although not illustrated, the target space 100 is provided with window fixtures such as curtains and blinds that control an external environment such as a temperature, humidity, an amount of solar radiation, and a solar radiation angle outside the target space 100, which affect the inside of the target space 100 through windows.

Further, in the following description, the horizontal direction of the target space 100 is referred to as a planar direction, and the vertical direction is referred to as a height direction.

The air conditioner 10 is a device that adjusts an air environment of the target space 100. The air conditioner 10 includes the indoor unit 11 and an outdoor unit 12. Furthermore, although FIG. 1 illustrates an example in which there are the one indoor unit 11 and the one outdoor unit 12 in the target space 100 for convenience, a plurality of the indoor units 11 and a plurality of the outdoor units 12 may be provided.

The indoor unit 11 is installed in the target space 100 to exchange heat between the refrigerant having passed through a pipe and the air in the target space 100 and thus absorb heat from the air in the target space 100 and discharge heat into the target space 100. The outdoor unit 12 is installed outside the target space 100 to exchange heat between the refrigerant having passed through a pipe and the air outside the target space 100 and thus discharge heat to the outside of the target space 100 and absorb heat from the air outside the target space 100.

As the environment sensor 20, a temperature detection sensor using an element such as a thermistor is used. The environment sensor 20 is provided in the target space 100, for example, at a position different from the position where the indoor unit 11 is provided. Examples of the environment sensor 20 may include a temperature sensor provided in a remote controller that receives user operations for the air conditioner 10.

The environment sensor 20 associates the detected environment information with time information that is the information on the date and time when the temperature and the humidity are detected. Then, the environment sensor 20 sends the environment information, which is the information on the detected temperature and humidity, to the server device 40.

A device that may be carried by a user, e.g., a mobile phone such as a smartphone or a portable terminal device such as a tablet terminal, may be used as the information terminal device 30.

The information terminal device 30 according to the present embodiment is provided with a touch panel on a display screen 300. When the user touches the display screen 300, the information terminal device 30 receives operations on the image displayed on the display screen 300 and instructions via the display screen 300. Further, the display screen 300 of the information terminal device 30 displays the presentation information received from the server device 40.

Furthermore, the information terminal device 30 receives the setting of a set temperature for the air conditioner 10 from the user. That is, the information terminal device 30 also functions as a remote controller that controls the air conditioner 10 via the server device 40.

Moreover, the display of the presentation information of the server device 40 and the control of the air conditioner 10 using the information terminal device 30 will be described below in detail.

The server device 40 estimates an environment including a temperature at a specific position different from a measurement position in the target space 100 based on the device information on the air conditioner 10, the space information on the target space 100 where the air conditioner 10 is installed, and the environment information including the temperature at the measurement position in the target space 100. Then, based on the estimation of the environment, the server device 40 presents the range of the environment including a temperature adjustable by the air conditioner 10 at the specific position and the spatial range in the target space adjustable to a predetermined environment including a temperature by the air conditioner 10. Furthermore, the server device 40 according to the present embodiment transmits the control information on the air conditioner 10 to the air conditioner 10 to control the air conditioner 10.

Further, the server device 40 according to the present embodiment functions as an example of an information processing device.

Moreover, the indoor unit 11 or the outdoor unit 12 of the air conditioner 10 may be configured to have the above-described function of the server device 40. In this case, the indoor unit 11 or the outdoor unit 12 according to the present embodiment functions as an example of the information processing device.

Figure 2:
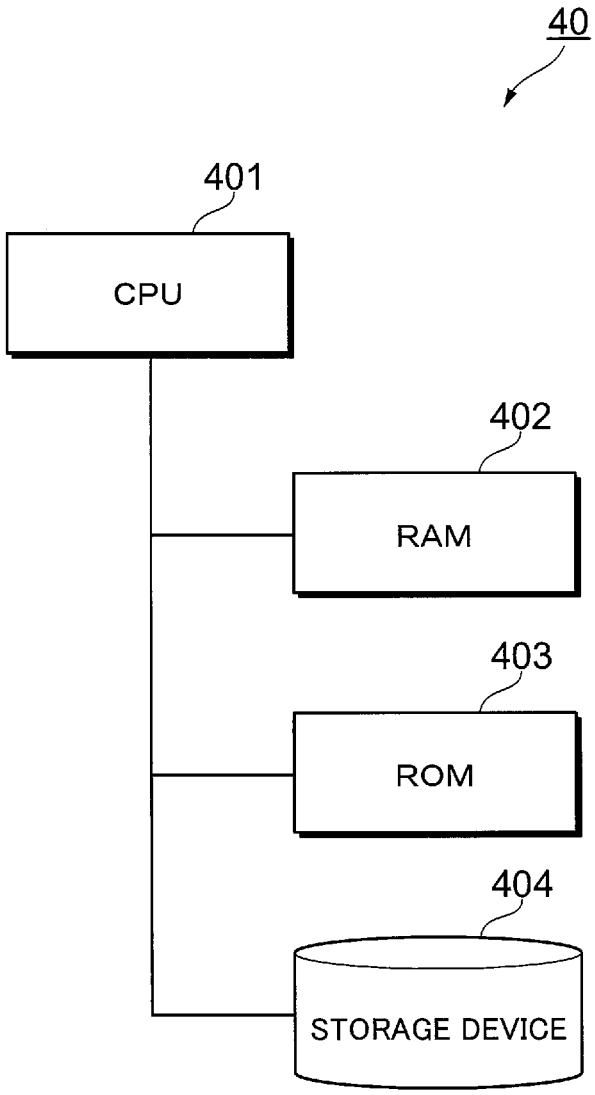
FIG. 2 is a diagram illustrating an example of a hardware configuration of a server device according to the present embodiment.

FIG. 2 is a diagram illustrating an example of a hardware configuration of the server device 40 according to the present embodiment.

As illustrated in FIG. 2, the server device 40 includes a CPU (Central Processing Unit) 401 as a calculation unit, a RAM (Random Access Memory) 402 as a storage unit, a ROM (Read Only Memory) 403, and a storage device 404. The RAM 402 is a main storage device (main memory) and is used as a working memory when the CPU 401 performs calculation processing. The ROM 403 stores programs and prepared data such as setting values, and the CPU 401 reads the programs and data directly from the ROM 403 and processes them. The storage device 404 is a unit that stores programs and data. The storage device 404 stores programs, and the CPU 401 reads the program stored in the storage device 404 into the main storage device and processes the program. Further, the storage device 404 stores results of processing by the CPU 401. For example, a magnetic disk device or an SSD (Solid State Drive) is used as the storage device 404.

Furthermore, the basic configuration of the hardware of the air conditioner 10, the environment sensor 20, and the information terminal device 30 is the same as that of the server device 40 described above.

Figure 3:
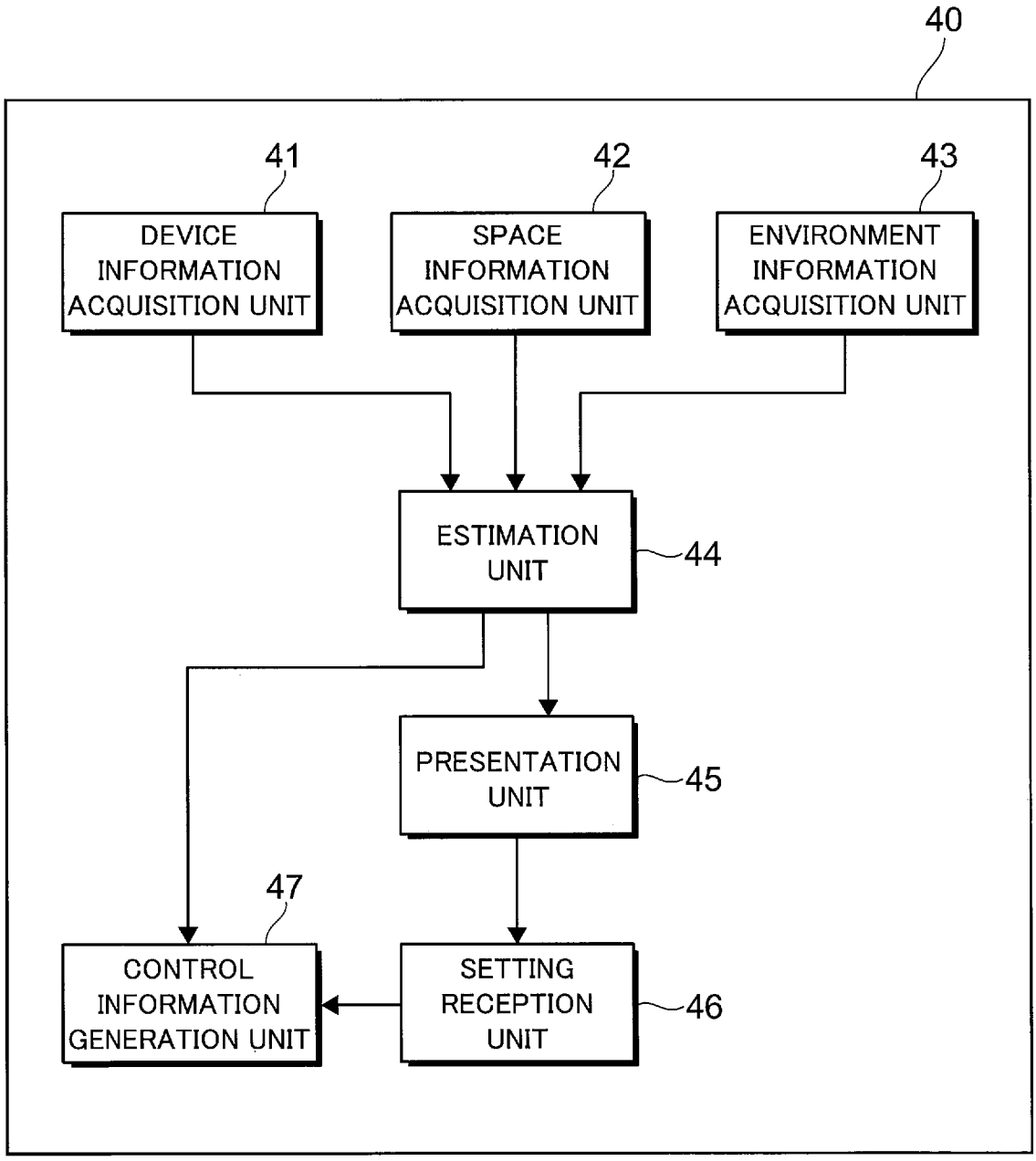
FIG. 3 is a functional block diagram of the server device according to the present embodiment.

FIG. 3 is a functional block diagram of the server device 40 according to the present embodiment.

As illustrated in FIG. 3, the server device 40 according to the present embodiment includes a device information acquisition unit 41 that acquires the device information on the air conditioner 10, a space information acquisition unit 42 that acquires the space information on the target space 100, and an environment information acquisition unit 43 that acquires the environment information on a measurement position in the target space 100. Further, the server device 40 includes an estimation unit 44 that estimates an environment at a position (hereafter, referred to as specific position) different from the measurement position in the target space, a presentation unit 45 that presents presentation information to the user based on the estimation of the environment by the estimation unit 44, and a setting reception unit 46 that receives the setting of a temperature at a predetermined position in the target space 100. Further, the server device 40 includes a control information generation unit 47 that generates control information for controlling the air conditioner 10 based on the setting received by the setting reception unit 46.

The device information acquisition unit 41 acquires the device information, which is information about the air conditioner 10. The device information includes performance information about the performance of the air conditioner 10 and the control information about the control of the air conditioner 10.

The performance information includes, for example, information such as the heating capacity and the cooling capacity of the air conditioner 10 and the specifications of the air conditioner 10 such as the blow-out area of the indoor unit 11.

The control information includes the air volume of the indoor unit 11 of the air conditioner 10, the wind direction in the indoor unit 11, the temperature of the refrigerant of the indoor unit 11, and the like.

Furthermore, the device information acquisition unit 41 may acquire the device information from the air conditioner 10, input by the user, or the like, or an external device not illustrated.

The space information acquisition unit 42 acquires the space information that is the information on the target space 100 itself and the information on an object installed in the target space 100.

The space information includes information on the spread of the target space 100 in the planar direction and the spread of the target space 100 in the height direction. The space information includes the size information and the shape information on the target space 100 such as a floor area, a volume, a ceiling height, and a layout of the target space 100. Here, the size information may be, for example, dimension information.

The space information includes the information on the position in the height direction and the position in the planar direction of the indoor unit 11 of the air conditioner 10 set in the target space 100. Further, the space information includes information on the positions of the heat generating furniture and fixtures and the non-heat generating furniture and fixtures.

Furthermore, the space information includes information such as the position and size of a window and the position and size of a curtain or a blind in the target space 100.

Moreover, these pieces of space information are examples of the information on objects that affect the temperature environment in the target space 100.

The environment information acquisition unit 43 acquires the environment information measured by, for example, the environment sensor 20 and the indoor unit 11. The environment information includes information on air qualities such as temperature, humidity, carbon dioxide, and odor. According to the present embodiment, the environment information acquisition unit 43 acquires, for example, information on the temperature as the environment information. Specifically, the environment information acquisition unit 43 acquires, as the environment information, the temperature actually measured by the environment sensor 20 provided at a predetermined position in the target space 100. Furthermore, the environment information acquisition unit 43 acquires, as the environment information, the intake temperature actually measured by a temperature sensor built in the indoor unit 11 installed in the target space 100.

The estimation unit 44 estimates the environment at a specific position different from the measurement position of the environment information in the target space 100 based on the device information, the space information, and the environment information. In order to estimate the temperature environment in the target space 100, the estimation unit 44 uses a physical model obtained by modeling the inside of the target space 100. Further, the estimation unit 44 uses the physical model and the temperature information measured in at least one point provided in the target space 100 to estimate the temperature at a point that is not measured in the target space 100.

The estimation unit 44 estimates the temperature at the specific position, at which the temperature is desired to be obtained, among a plurality of positions in the target space 100. The estimation unit 44 uses the physical model, which is obtained by modeling the inside of the target space 100, to calculate a temperature difference between the temperature indicated by the environment information acquired by the environment information acquisition unit 43 and the temperature at the specific position. It may be exemplified that the physical model used by the estimation unit 44 according to the present embodiment includes the following terms.

The physical model according to the present embodiment includes terms that define the thermal diffusivity and the thermal conductivity from the installation position of the environment sensor 20 to the specific position. The thermal diffusivity and the thermal conductivity may be calculated from the information on the size of the target space 100 acquired by the space information acquisition unit 42.

Furthermore, the physical model according to the present embodiment includes terms that define effects of the blow-out temperature, the blow-out humidity, the wind direction, the wind speed, and the air volume of the indoor unit 11 of the air conditioner 10 on the temperature at the specific position. The blow-out temperature, the blow-out humidity, the wind direction, the wind speed, and the air volume of the indoor unit 11 may be acquired from the device information acquisition unit 41.

Furthermore, the physical model according to the present embodiment includes terms that define effects of an external environment such as the temperature, the humidity, the amount of solar radiation, and the solar radiation angle outside the target space 100 on the temperature at the specific position. Here, the effect of the external environment on the temperature at the specific position includes an effect of the external environment through a window 140, wall, floor, or ceiling of the target space 100 and an effect of the external environment directly flowing into the target space 100. The temperature, the humidity, the amount of solar radiation, and the solar radiation angle outside the target space 100 may be specified from, for example, weather information, which is an external information source, via the server device 40.

Further, the physical model according to the present embodiment includes a term that defines an effect of the heat generating furniture and fixture as a blocking body that blocks the flow of air in the target space 100 or as a heat generating body on the temperature at the specific position. The information on the heat generated by the heat generating furniture and fixture as a heat generating body may be specified from the information about the heat generating furniture and fixture in the space information acquired by the space information acquisition unit 42.

Furthermore, the physical model according to the present embodiment includes a term that defines an effect of the non-heat generating furniture and fixture as a blocking body that blocks the flow of air in the target space 100 on the temperature at the specific position. The effect of the non-heat generating furniture and fixture as the blocking body may be specified from the information about the non-heat generating furniture and fixture in the space information acquired by the space information acquisition unit 42.

Further, the physical model according to the present embodiment includes a term that defines an effect on the temperature at the specific position by controlling the effect from the external environment outside the target space 100 by the window fixture. The information on the control by the window fixture may be specified from the space information acquired by the space information acquisition unit 42.

The estimation unit 44 uses the physical model including the above terms to calculate the temperature difference between the temperature acquired by the environment information acquisition unit 43 and the temperature at the specific position. Furthermore, the estimation unit 44 subtracts the calculated temperature difference from the temperature measured by the environment sensor 20 to estimate the temperature at the specific position.

Further, the estimation unit 44 divides the target space 100 into a plurality of grids in the planar direction and the height direction. The estimation unit 44 estimates the temperature for each of the grids formed by dividing the target space 100 into a plurality of spaces. In this way, the estimation unit 44 estimates the temperature distribution in the target space 100.

Further, the estimation unit 44 also specifies the time it takes for the temperature at the specific position to become the estimated temperature based on the physical model. Further, the estimation unit 44 holds the estimated temperature at the specific position as time-series data.

Furthermore, the estimation unit 44 uses the above-described physical model to change parameters such as the device information, the space information, and the environment information and thus estimates the temperature change in the target space 100. Specifically, the estimation unit 44 generates grids obtained by dividing the target space 100 into a plurality of regions. Further, the estimation unit 44 specifies a temperature for each of the grids when various parameters used in the physical model are changed. Accordingly, the estimation unit 44 estimates the range of an environment such as a temperature adjustable by the air conditioner 10 according to the present embodiment. For example, the estimation unit 44 estimates that the range of temperatures adjustable by the air conditioner 10 is a range from X° C. to Y° C. in a certain grid in the target space 100.

Furthermore, the estimation unit 44 estimates a spatial range in the target space 100 adjustable to a predetermined temperature by the air conditioner 10. For example, the estimation unit 44 estimates one or more grids adjustable to X° C. in the target space 100.

Further, the estimation unit 44 uses the physical model to estimate an adjustable range of temperatures at another specific position different from the predetermined position when the temperature at the predetermined position in the target space 100 is fixed. For example, the estimation unit 44 estimates that the range of temperatures adjustable by the air conditioner 10 in another grid is a range from X° C. to Y° C. in a state where the temperature of a certain grid in the target space 100 is maintained at Z° C. However, according the present embodiment, when it is said that the temperature is fixed or maintained, it is not required that the temperature is strictly maintained at the same temperature, and it is sufficient that the temperature is maintained within a certain temperature range.

Furthermore, the estimation of the environment by the estimation unit 44 is not limited to the example using the above-described physical model. For example, the estimation unit 44 may use machine learning to estimate the environment at the specific position.

In this case, the estimation unit 44 uses, as explanatory variables, the space information, the environment information that may be acquired at a certain point in time, and a control parameter of the air conditioner 10. Here, examples of the space information may include the information on the size of the target space 100 and the installation positions of the air conditioner 10, the heat generating furniture and fixture, and the non-heat generating furniture and fixture installed in the target space 100. Examples of the environment information may include the temperature measured by the environment sensor 20 and the intake temperature of the indoor unit 11. Examples of the control parameter may include the blow-out area of the indoor unit 11, the number of rotations of a fan corresponding to the air volume of the indoor unit 11, a refrigerant temperature related to a blow-out temperature, and an angle of a flap of the indoor unit 11.

The estimation unit 44 uses, as objective variables, an actual measurement value obtained by a plurality of temperature detection sensors installed in the target space 100 or a simulation value obtained by numerical calculation such as CFD (Computational Fluid Dynamics), which is a value obtained after a predetermined time elapses from the change of various parameters.

Furthermore, the estimation unit 44 uses a learned model obtained by supervised learning using the explanatory variable and the objective variable to estimate the environment such as the temperature at the specific position in the target space 100. Further, the estimation unit 44 according to the present embodiment uses the environment information measured in at least one point in the target space 100 when estimating the environment using the learned model and thus improves the estimation accuracy.

Further, for example, the estimation unit 44 may use a prediction model obtained by model prediction control for controlling the air conditioner 10 that adjusts the air environment in the target space 100 to estimate the air environment in the target space 100.

Furthermore, when using for example the physical model to change the parameter related to the device information and estimate the environment of the target space 100, the estimation unit 44 may use not only the condition of the air conditioner 10 installed in the target space 100 but also the condition in a case where it is assumed that the air conditioner 10 is installed in the target space 100. In this case, for example, the estimation unit 44 may estimate the environment of the target space 100 in a case where the different air conditioner 10 is newly added to the target space 100 or the model of the air conditioner 10 is changed. In addition, the estimation unit 44 may estimate for example the range of an environment such as adjustable temperature in the target space 100.

The presentation unit 45 generates the presentation information to be presented to the user based on the information on the environment of the temperature at the specific position estimated by the estimation unit 44. Furthermore, according to the present embodiment, the presentation unit 45 transmits the presentation information to the information terminal device 30 and causes the display screen 300 to present the presentation information.

The presentation unit 45 according to the present embodiment presents, as the presentation information, the range of temperatures adjustable by the air conditioner 10 at the specific position in the target space 100. Furthermore, the presentation unit 45 presents, as the presentation information, the spatial range in the target space 100 adjustable to a predetermined temperature by the air conditioner 10. Further, the presentation unit 45 presents, as the presentation information, the range of adjustable temperature at another specific position while maintaining the temperature at the predetermined position in the target space 100 at the predetermined temperature.

Furthermore, when the setting reception unit 46 described above receives the setting of the set temperature for the air conditioner 10, the presentation unit 45 according to the present embodiment presents for example the adjustment range of the temperature to the user. Thus, the user may set the set temperature after knowing the range of temperatures adjustable by the air conditioner 10 and the spatial range adjustable to the predetermined temperature.

The setting reception unit 46 receives, for example from the user in the target space 100, the target set temperature for the adjustment of the air conditioner 10 in the target space 100. In particular, the setting reception unit 46 according to the present embodiment receives the setting of the set temperature at the predetermined position in the target space 100. The setting reception unit 46 according to the present embodiment causes the display screen 300 to display a setting screen 70 for the user to set the set temperature in the information terminal device 30 (see FIGS. 7A and 7B described below). Furthermore, the setting reception unit 46 receives the designation of the set temperature and the designation of the position to be set to the set temperature from the user via the setting screen 70 displayed on the display screen 300 of the information terminal device 30.

Further, the setting reception unit 46 sends the information on the set temperature received from the user to the control information generation unit 47.

The control information generation unit 47 generates the control information for controlling the air conditioner 10 based on the information of the set temperature and the designated position received by the setting reception unit 46 from the user and the information on the environment of the temperature at the specific position estimated by the estimation unit 44.

Specifically, the control information generation unit 47 uses the physical model used for the estimation by the estimation unit 44 to specify the control parameter of the air conditioner 10 that satisfies the condition of the set temperature and the designated position thereof received by the setting reception unit 46. Further, the control information generation unit 47 transmits, to the air conditioner 10, the control parameter of the air conditioner 10 that satisfies the condition of the set temperature and the designated position received by the setting reception unit 46.

Next, a specific operation of the server device 40 will be described.

Figure 4:
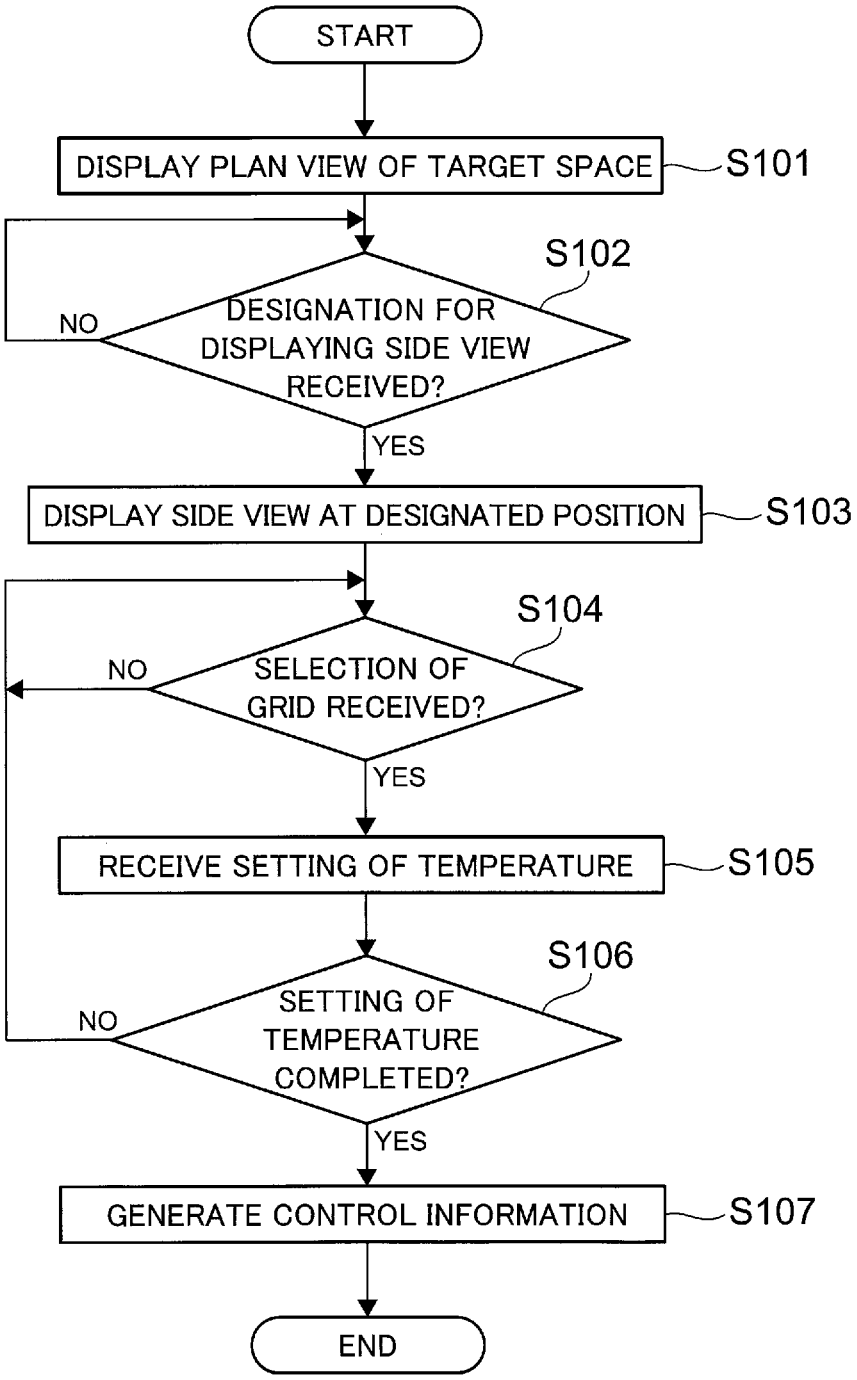
FIG. 4 is a flow chart of an operation performed by the server device according to the present embodiment.

FIG. 4 is a flow chart of an operation performed by the server device 40 according to the present embodiment.

Figure 5:
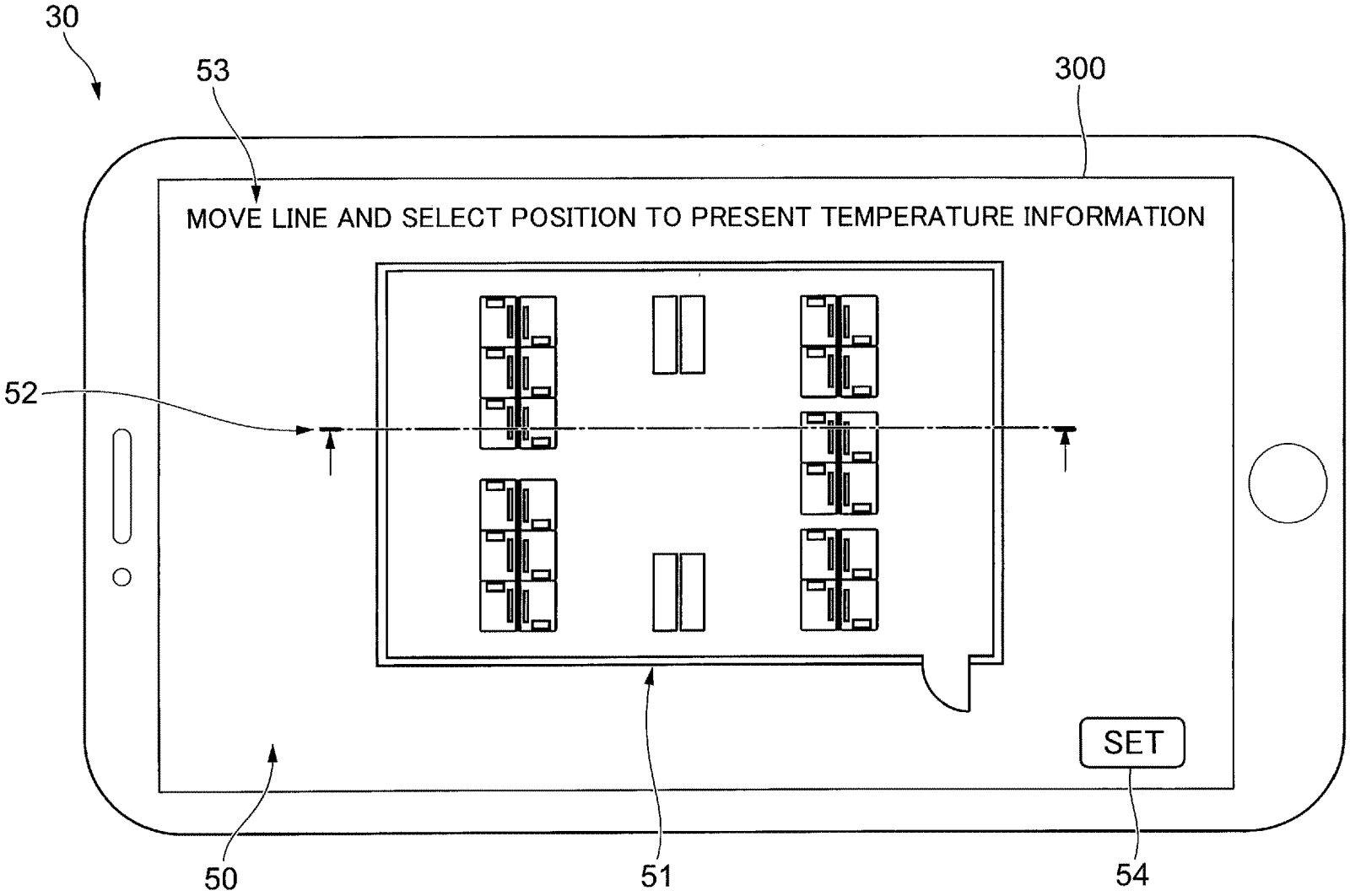
FIG. 5 is a diagram of an example of a reception screen displayed on a display screen of an information terminal device.

FIG. 5 is a diagram of an example of a reception screen 50 displayed on the display screen 300 of the information terminal device 30.

Figure 6:
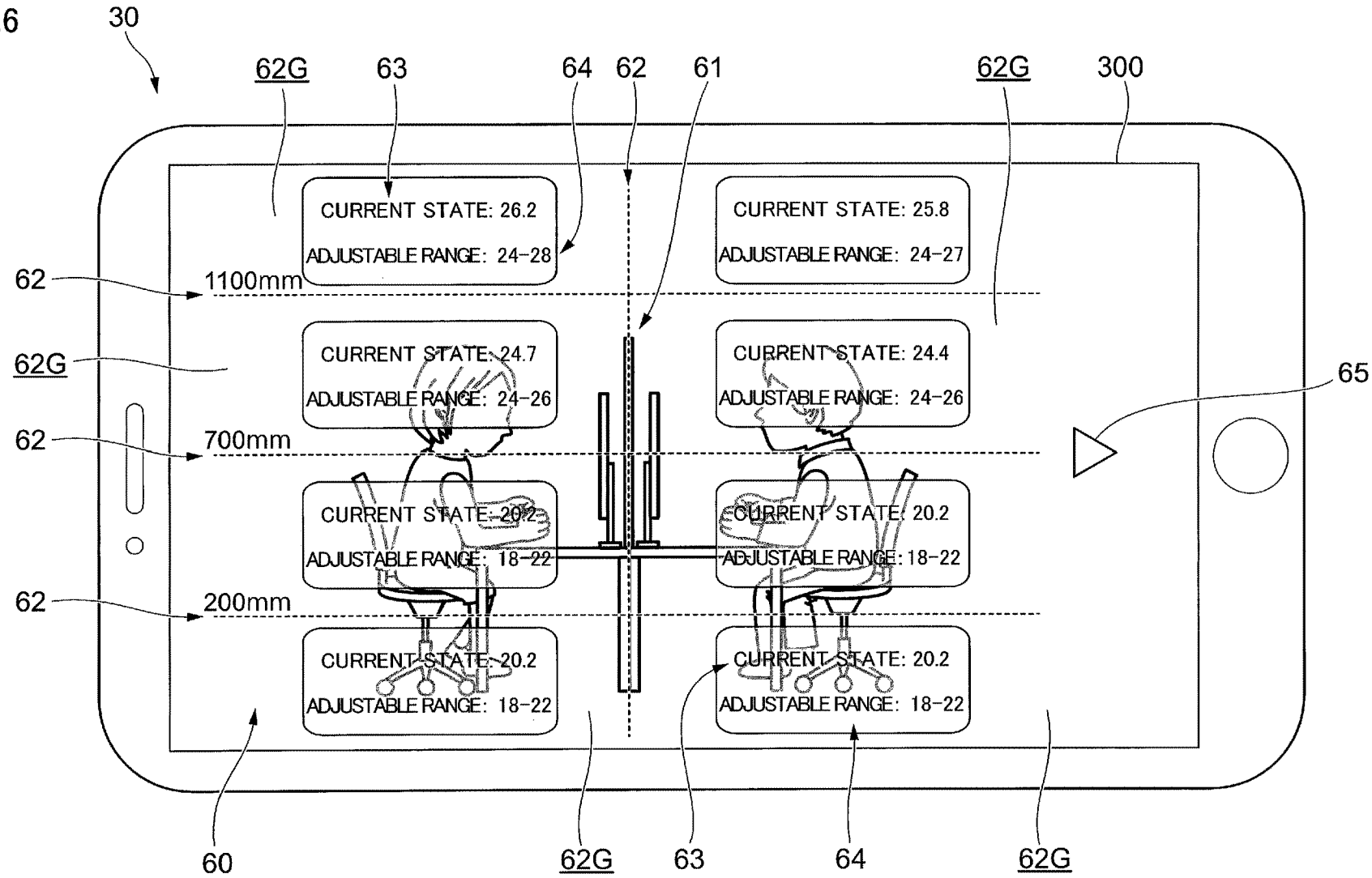
FIG. 6 is a diagram of an example of a presentation screen displayed on the display screen of the information terminal device.

FIG. 6 is a diagram of an example of a presentation screen 60 displayed on the display screen 300 of the information terminal device 30.

Figure 7A:
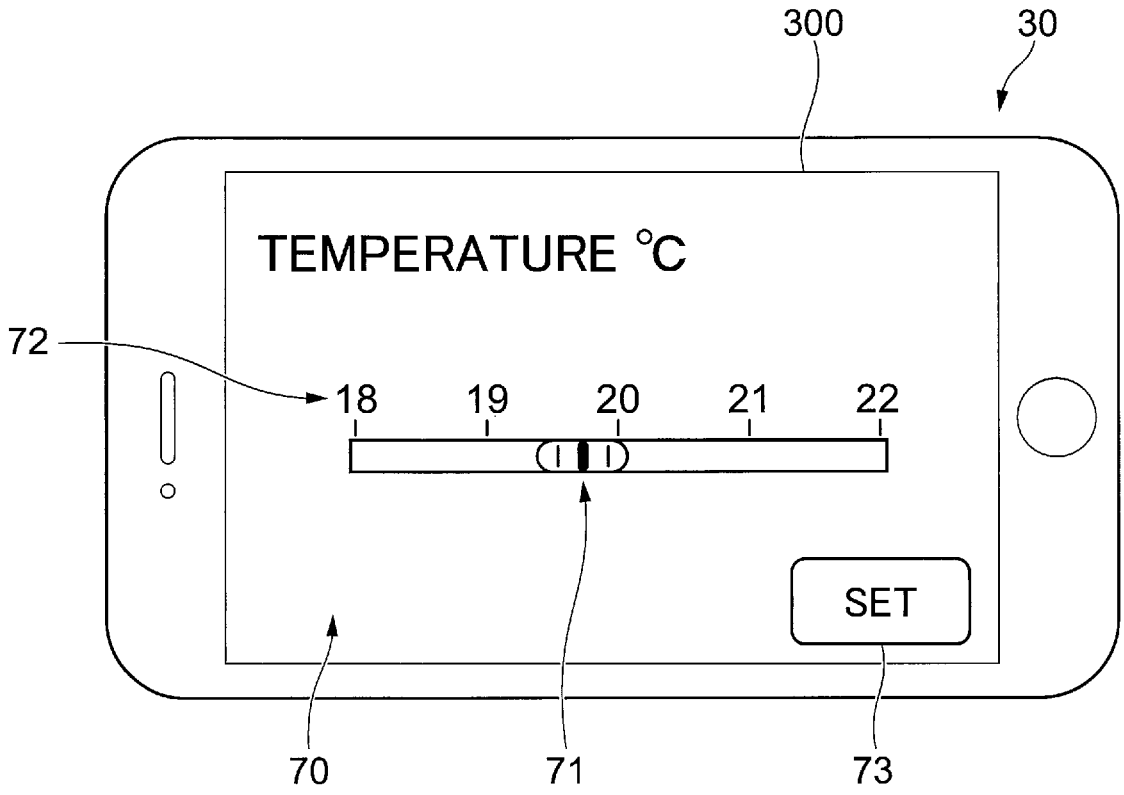
FIGS. 7A and 7B are diagrams of examples of a setting screen displayed on the display screen of the information terminal device.
Figure 7B:
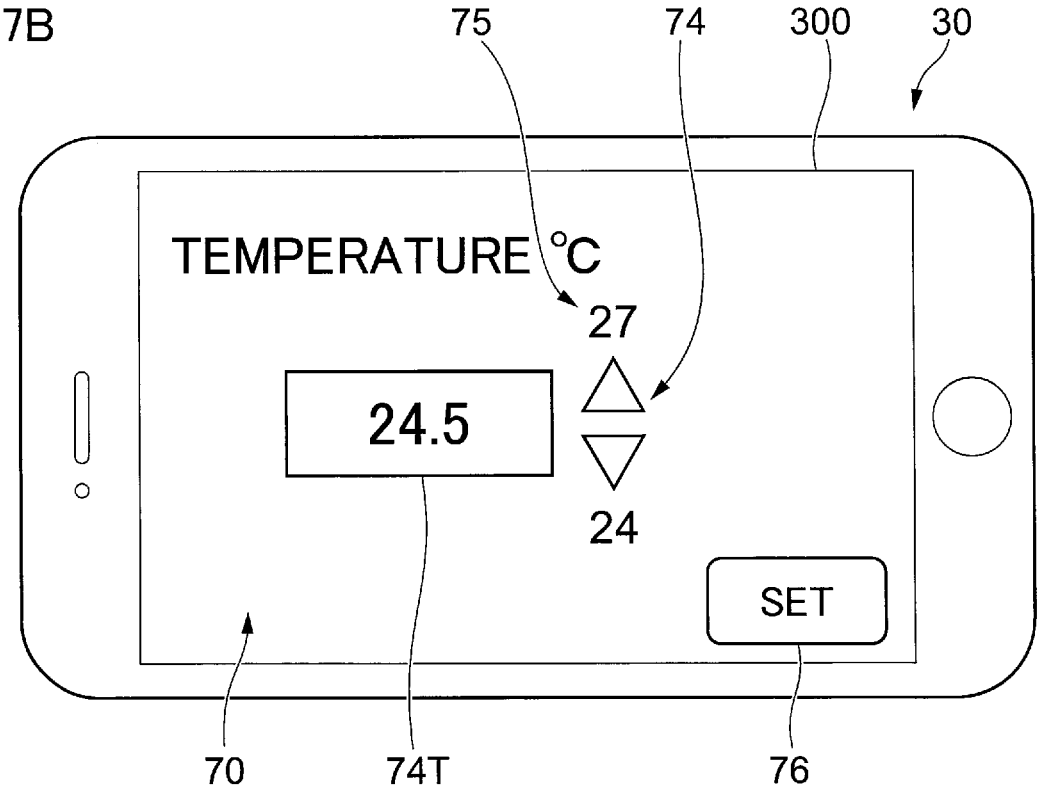

FIGS. 7A and 7B are diagrams of examples of a setting screen 70 displayed on the display screen 300 of the information terminal device 30.

As illustrated in FIG. 4, the presentation unit 45 of the server device 40 displays a plan view of the target space 100 on the display screen 300 of the information terminal device 30 (Step 101). Specifically, as illustrated in FIG. 5, the display screen 300 displays the reception screen 50. Further, the reception screen 50 displays a plan view 51 of the target space 100, a side view line 52, an instruction message 53, and a setting button 54.

The plan view 51 is a view of an office, which is illustrated as an example of the target space 100 according to the present embodiment, when viewed from above in the vertical direction. The plan view 51 illustrates the boundary of a room with the image of walls. Further, the plan view 51 also illustrates images of a personal computer, a desk, and the like.

Moreover, the plan view 51 may be a schematic view of the target space 100 or an actually taken photograph of the target space 100.

The side view line 52 is a guide to receive the designation of the position that is the display target of a side view 61 described below of the target space 100. The side view line 52 moves with respect to the plan view 51 in response to a touch operation on the display screen 300 by the user.

The instruction message 53 instructs the user to move the side view line 52. The instruction message 53 indicates that the side view line 52 is to be moved and the temperature information at the position corresponding to the side view line 52 is to be displayed, e.g., "Move the line and select the position to present the temperature information".

The setting button 54 is a button image to receive a setting from the user to display the side view 61 (described below) at the position of the side view line 52 for displaying the side view.

Then, as illustrated in FIG. 4, the server device 40 determines whether the designation for displaying the side view 61 (described below) has been received (Step 102).

It may be determined whether the designation for displaying the side view 61 has been received depending on whether the setting button 54 (see FIG. 5) of the reception screen 50 has been selected and operated. Then, when the setting button 54 is selected, the server device 40 determines that the designation for displaying the side view 61 has been received (YES in Step 102) and displays the side view 61 at the position designated by the side view line 52 on the display screen 300 of the information terminal device 30 (Step 103).

As illustrated in FIG. 6, the display screen 300 of the information terminal device 30 displays the presentation screen 60. Further, the presentation screen 60 displays the side view 61 of the target space 100, grid lines 62 to indicate a plurality of grids, current state temperature information 63, adjustable range information 64, and a display movement button 65.

The side view 61 is a view of the office, which is illustrated as an example of the target space 100 according to the present embodiment, when viewed from a direction along the horizontal direction. The side view 61 also displays images of a personal computer, a desk, and the like. Furthermore, the side view 61 may be a schematic view of the target space 100 or an actually taken photograph of the target space 100.

The grid lines 62 are lines indicating the boundaries of grids 62G when the target space 100 is divided into the plurality of grids 62G. In the example of the presentation screen 60 of FIG. 6, the target space 100 displayed as the side view 61 is divided into four regions in the vertical direction, and the plurality of grids 62G divided into two regions in the horizontal direction is displayed. Further, the presentation screen 60 also displays a specific numerical value of the height in the vertical direction indicated by the grid line 62.

The current state temperature information 63 is displayed for each of the grids 62G. Furthermore, the current state temperature information 63 indicates the temperature of each of the grids 62G estimated by the estimation unit 44. According to the present embodiment, the current state temperature information 63 is the temperature estimated at the time point when the presentation screen 60 is displayed. This allows the user who refers to the presentation screen 60 to know for example the temperature estimated at the position where the user is present. In particular, the current state temperature information 63 is displayed for each of the grids 62G divided in the vertical direction. Therefore, the user may know the temperature at each height such as the head, body, and feet.

The adjustable range information 64 is displayed for each of the grids 62G. Furthermore, the adjustable range information 64 indicates the range of temperatures adjustable by the air conditioner 10 for the grid 62G. This range of temperatures is estimated by the estimation unit 44. This allows the user to know the temperature that may be achieved by using the air conditioner 10 for each of the grids 62G.

The display movement button 65 is a button image used to move the side view 61 displayed on the display screen 300. The display movement button 65 is operated by the user to change the region of the side view 61 displayed on the display screen 300. Further, in accordance with a change in the region of the side view 61 displayed on the display screen 300, the current state temperature information 63 and the adjustable range information 64 of the grid 62G in the region are displayed.

As described above, the current state temperature information 63 and the adjustable range information 64 for each of the grids 62G are displayed on the presentation screen 60 so as to be superimposed on the side view 61 of the target space 100. Furthermore, when the position of the side view line 52 on the reception screen 50 illustrated in FIG. 5 is changed, the current state temperature information 63 and the adjustable range information 64 corresponding to the grid 62G in a different side view are displayed again.

Furthermore, as illustrated in FIG. 4, when the designation for displaying the side view 61 has not been received (NO in Step 102), the process returns to Step 102 again so that the reception of the designation for displaying the side view 61 is continued.

Then, as illustrated in FIG. 4, it is determined whether the selection of one of the grids 62G from among the plurality of grid 62G by the user has been received (Step 104).

When the selection of one of the grids 62G has been received (YES in Step 104), the display screen 300 displays the setting screen 70 (see FIGS. 7A and 7B described below), and the setting of the temperature for the grid 62G is received (Step 105).

As illustrated in FIGS. 7A and 7B, the display screen 300 of the information terminal device 30 displays the setting screen 70 to receive the set temperature for each of the grids 62G from the user.

Further, as illustrated in FIG. 7A, the setting screen 70 displays a slider image 71, a temperature range display 72, and a setting button 73.

The slider image 71 may be moved by a touch operation of the user. Furthermore, the temperature corresponding to the position where the slider image 71 is arranged is set as the set temperature.

The temperature range display 72 displays the range of adjustable temperature in the selected grid 62G. The temperature range display 72 corresponds to the adjustable range information 64 in the grid 62G. Furthermore, the temperature range display 72 displays the temperature from the lower limit value to the upper limit value in the adjustable range information 64. The temperature range display 72 displays the lower limit value and the upper limit value of the temperature that is different for each of the grids 62G.

Further, the slider image 71 is movable in accordance with the temperature range display 72. Therefore, the slider image 71 cannot be positioned at a temperature that falls outside the range between the lower limit value and the upper limit value of the temperature range display 72. The setting screen 70 does not accept a temperature that falls outside the temperature range of the adjustable range information 64.

The setting button 73 is a button image to receive, from the user, the confirmation of setting of the temperature using the slider image 71. When the setting button 73 is selected, the temperature corresponding to the position of the slider image 71 is set as the set temperature.

The setting screen 70 according to another example illustrated in FIG. 7B displays an up/down button 74, a temperature range display 75, and a setting button 76.

The up/down button 74 includes a button to increase the temperature as the set temperature and a button to decrease the temperature as the set temperature. Further, the numerical value of a temperature display 74T changes in response to an operation on the up/down button 74.

The temperature range display 75 displays the range of adjustable temperature in the selected grid 62G. The temperature range display 75 corresponds to the adjustable range information 64 in the grid 62G. Further, the temperature range display 75 displays the lower limit value and the upper limit value of the temperature in the adjustable range information 64. The temperature range display 75 displays the lower limit value and the upper limit value of the temperature that is different for each of the grids 62G.

Furthermore, the temperature display 74T cannot display a temperature that falls outside the range between the lower limit value and the upper limit value of the temperature range display 75 by an operation on the up/down button 74. Moreover, the setting screen 70 according to another example does not accept a temperature that falls outside the temperature range of the adjustable range information 64.

The setting button 76 is a button image to receive, from the user, the confirmation of setting of the set temperature using the up/down button 74. When the setting button 76 is selected, the temperature corresponding to the position of the up/down button 74 is set as the set temperature.

As illustrated in FIG. 4, when the selection of one of the grids 62G has not been received (NO in Step 104), the process returns to Step 104 so that the reception of the grid 62G is continued.

Then, as illustrated in FIG. 4, it is determined whether the setting of the set temperature has been completed (Step 106). When the setting of the set temperature has not been completed (NO in Step 106), the process returns to Step 104 so that the selection of the grid is received.

Conversely, when the setting of the set temperature has been completed (YES in Step 106), the control information is generated (Step 107).

Furthermore, when the user designates a predetermined temperature as the set temperature, the display screen 300 may display the time it takes to become the designated temperature. In this case, the display screen 300 may display, for example, the time it takes to become the predetermined temperature or a rough estimate of the time. In addition, the information terminal device 30 may notify the user of the time at which the designated grid 62G is estimated to become the predetermined temperature by using a sound such as an alarm.

Next, a presentation screen according to another example displayed on the display screen 300 of the information terminal device 30 will be described.

Figure 8:
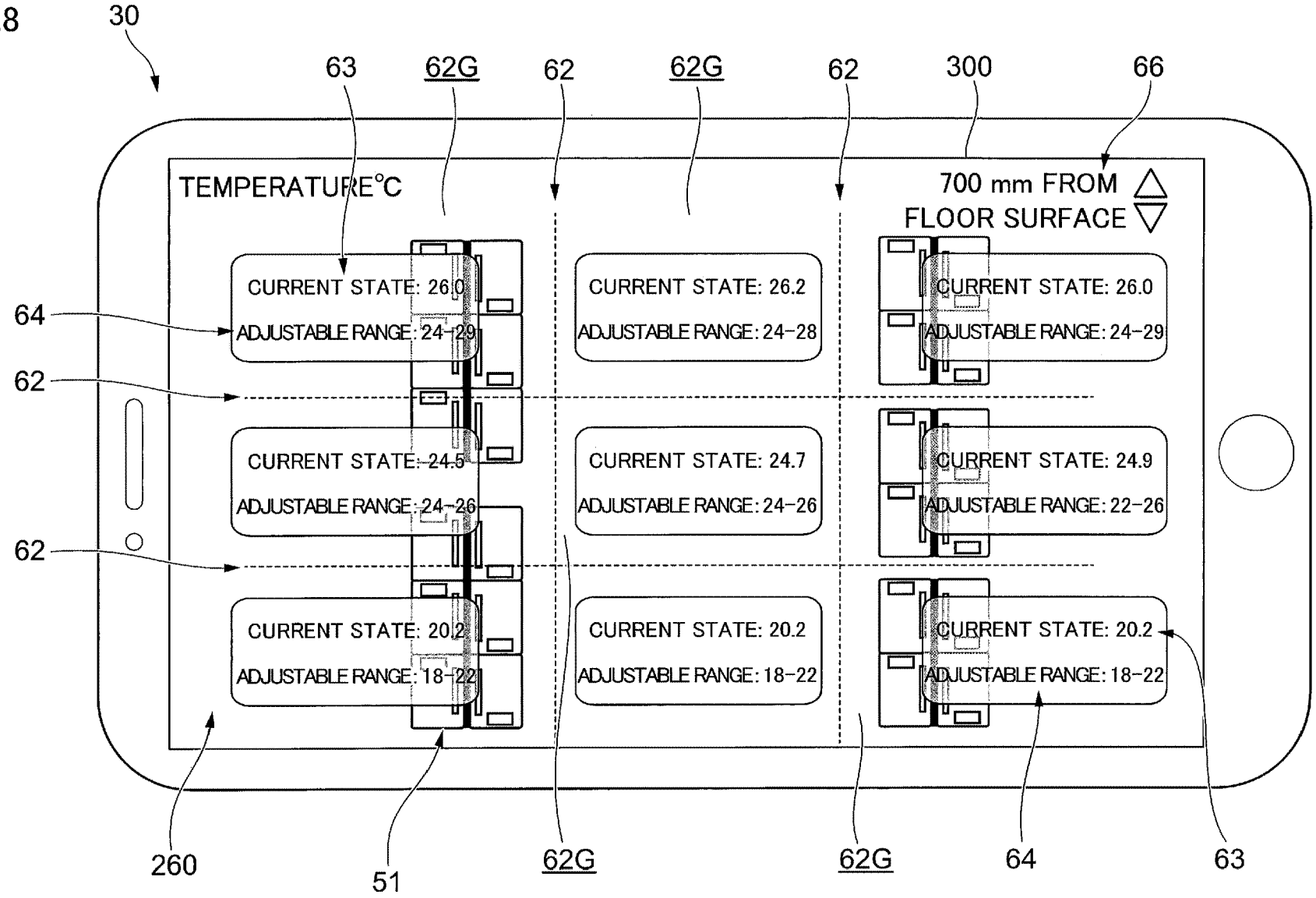
FIG. 8 is a diagram of an example of a presentation screen displayed on the display screen of the information terminal device.

FIG. 8 is a diagram of an example of a presentation screen 260 displayed on the display screen 300 of the information terminal device 30.

As illustrated in FIG. 8, the display screen 300 of the information terminal device 30 displays the presentation screen 260. Further, the presentation screen 260 displays the plan view 51 of the target space 100, the grid lines 62 indicating a plurality of grids, the current state temperature information 63, the adjustable range information 64, and a change button 66.

On the presentation screen 260 according to another example, the grid line 62 is displayed on the plan view 51 of the office, which is illustrated as an example of the target space 100, when viewed from a direction along the vertical direction, and the plurality of grids 62G divided into a plurality of regions is displayed.

Further, the current state temperature information 63 and the adjustable range information 64 are displayed on each of the grids 62G.

The change button 66 is a button image to receive an operation of changing the height of the plurality of grids 62G displayed on the display screen 300. For example, the example illustrated in FIG. 8 illustrates the content in a case where the plurality of grids 62G has a height of 700 mm from the floor surface. In this case, the current state temperature information 63 and the adjustable range information 64 displayed in the plurality of grids 62G have contents corresponding to a height of 700 mm from the floor surface.

Furthermore, the change button 66 may be operated to change the height of the grid 62G from the floor surface. When the height is changed by the change button 66, the current state temperature information 63 and the adjustable range information 64 of the grid 62G corresponding to the changed height are displayed.

As described above, the presentation screen 260 according to another example displays the current state temperature information 63 and the adjustable range information 64 for each of the grids 62G so as to be superimposed on the plan view 51 of the target space 100. Further, the change button 66 is operated so that the display screen 300 may display the current state temperature information 63 and the adjustable range information 64 corresponding to the grids 62G having different heights.

As described above, the user uses the information terminal device 30 to know for example the temperature in the place where the user is present. In this case, the user may know the temperature in each of the grids 62G at a different height in the vertical direction, for example. Furthermore, the user may know the range of temperatures adjustable by the air conditioner 10 for each of the grids 62G. Moreover, the user may designate the set temperature for each of the grids 62G.

In the example described with reference to the drawings, the range of adjustable temperature is displayed for each of the grids 62G, but this example is not a limitation. For example, the server device 40 may display, on the display screen 300 of the information terminal device 30, the spatial range in the target space 100 adjustable to a predetermined temperature by the air conditioner 10.

Next, an example describing the spatial range in the target space 100 adjustable to a predetermined environment including a temperature by the air conditioner 10 will be described.

Figure 9:
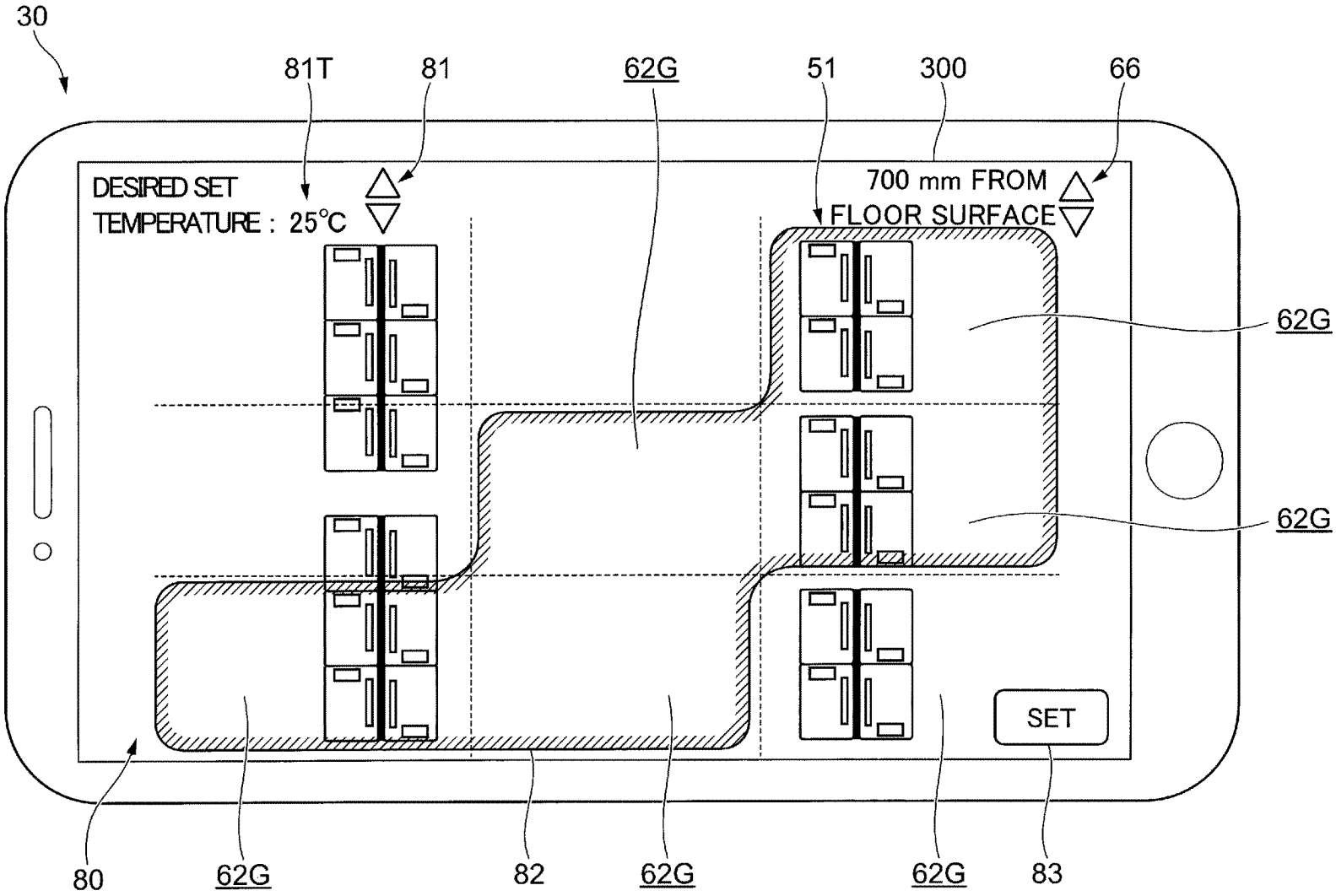
FIG. 9 is a diagram of an example of a presentation screen displayed on the display screen of the information terminal device.

FIG. 9 is a diagram of an example of a presentation screen 80 displayed on the display screen 300 of the information terminal device 30.

The server device 40 receives a desired set temperature from the user via the display screen 300 of the information terminal device 30. Then, in the server device 40 according to the present embodiment, the estimation unit 44 estimates the spatial range in the target space 100 adjustable to the desired set temperature by the air conditioner 10. Then, the server device 40 displays the estimated spatial range as the presentation information on the display screen 300 of the information terminal device 30.

As illustrated in FIG. 9, the presentation screen 80 displays a reception button 81 to receive the set temperature desired by the user. The user operates the reception button 81 to designate the desired set temperature. A temperature display 81T displays the set temperature designated by the reception button 81.

Furthermore, the presentation screen 80 displays a range display 82 indicating the spatial range adjustable to the set temperature desired by the user. In this case, the range display 82 is superimposed on the plan view 51 of the target space 100 on the presentation screen 80.

In the example of the presentation screen 80 illustrated in FIG. 9, the range display 82 is displayed across the plurality of grids 62G. This allows the user to, for example, visually check the spatial range adjustable to the desired set temperature by the air conditioner 10 based on the plan view 51 of the target space 100.

Furthermore, the change button 66 to change the target height in the plan view 51 is also provided on the presentation screen 80. Therefore, when the user operates the change button 66, the presentation screen 80 displays the range display 82 at a predetermined height in the vertical direction.

On the presentation screen 80, when the user operates the reception button 81 to change the desired set temperature, the range display 82 is changed in accordance with the newly designated set temperature.

Furthermore, in some cases, the control by the air conditioner 10 may be desired with the contents of the desired set temperature presented on the presentation screen 80 and the range display 82 corresponding to the desired set temperature. In this case, the user operates a setting button 83 displayed on the display screen 300.

The control information generation unit 47 of the server device 40 generates the control information based on the control parameter of the air conditioner 10 when the estimation unit 44 performs estimation. Then, the server device 40 transmits the generated control information to the air conditioner 10.

As described above, the server device 40 presents the spatial range adjustable to the predetermined temperature on the presentation screen 80 and then receives, from the user, an instruction to control the air conditioner 10 to the predetermined temperature in the presented spatial range. In particular, as in the example illustrated in FIG. 9, the spatial range may extend over the plurality of grids 62G. In this case, the server device 40 receives the set temperatures for a plurality of positions in the target space via the presentation screen 80.

Next, an example will be described in which, while an environment such as a temperature at a certain position is maintained in the target space 100, the range of an environment such as a temperature adjustable at another position different from the certain position is presented.

Figure 10:
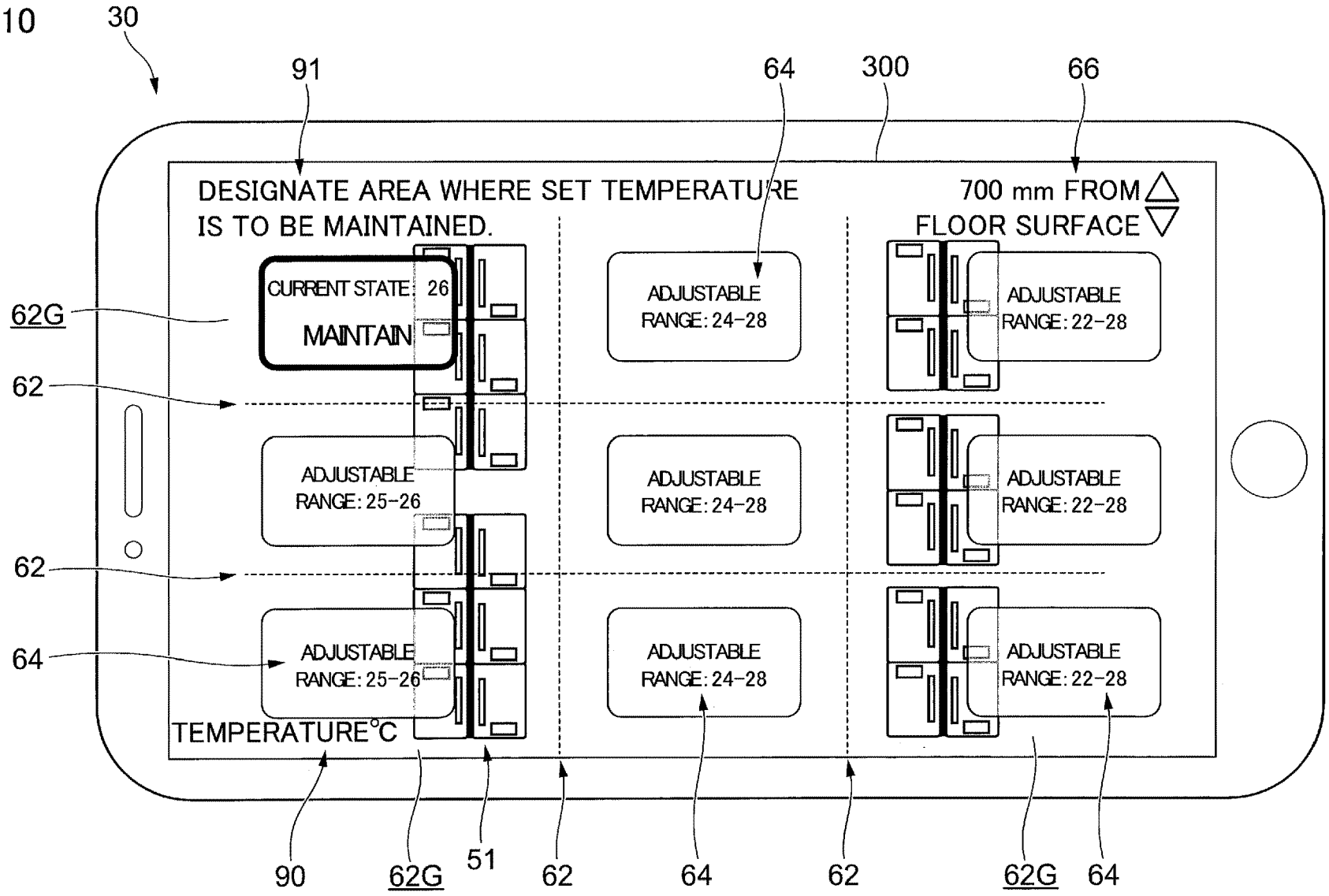
FIG. 10 is a diagram of an example of a presentation screen displayed on the display screen of the information terminal device.

FIG. 10 is a diagram of an example of a presentation screen 90 displayed on the display screen 300 of the information terminal device 30.

The server device 40 receives the designation of the grid 62G whose set temperature is to be maintained from the user via the display screen 300 of the information terminal device 30. Then, in the server device 40 according to the present embodiment, the estimation unit 44 estimates the range of temperatures adjustable by the air conditioner 10 for the grids 62G other than the designated grid 62G under the condition that the set temperature of the designated grid 62G is maintained. Then, the server device 40 displays the estimated temperature range as the presentation information on the display screen 300 of the information terminal device 30.

As illustrated in FIG. 10, the presentation screen 90 displays the plan view 51 of the target space 100, the grids 62G, and a designation message 91.

The designation message 91 instructs the user to designate the grid 62G whose set temperature is to be maintained, e.g., "Please designate the area where the set temperature is to be maintained".

Furthermore, when the designation of one of the grids 62G among the plurality of grids 62G is received from the user, the presentation screen 90 displays the target grid 62G in a mode different from that of the other grids 62G. In the example illustrated in FIG. 10, the text "maintain" is displayed in the designated upper-left grid 62G.

Further, the presentation screen 90 receives the set temperature of the designated grid 62G. In the example illustrated in FIG. 10, the current state temperature is set as the set temperature. Moreover, for the set temperature of the grid 62G to be designated, the designation of the set temperature may be received within the adjustable temperature range in the grid 62G.

Furthermore, the presentation screen 90 displays the adjustable range information 64 for each of the grids 62G other than the designated grid 62G.

As described above, the server device 40 displays the range of temperatures adjustable by the air conditioner 10 at another position in the target space 100 under the condition that the set temperature of one of the grids 62G is fixed.

Furthermore, the change button 66 to change the target height in the plan view 51 is also provided on the presentation screen 90. Therefore, when the user operates the change button 66, the presentation screen 90 displays the adjustable range information 64 for each of the grids 62G at a predetermined height in the vertical direction.

The processing performed by the server device 40 according to the present embodiment is prepared as a program such as application software.

The program is a program that causes a computer to perform the function of acquiring the device information on the air conditioner 10, the function of acquiring the space information on the target space 100 in which the air conditioner 10 is installed, the function of acquiring the environment information including at least a temperature at a measurement position in the target space 100, the function of estimating an environment including at least a temperature at a specific position different from the measurement position in the target space 100 based on the device information, the space information, and the environment information, and the function of presenting, based on estimation, the range of an environment including a temperature adjustable by the air conditioner 10 at the specific position and/or the spatial range in the target space 100 adjustable to a predetermined environment including a temperature by the air conditioner 10.

Furthermore, the program to implement the present embodiment may be provided not only by a communication unit but also by being stored in a recording medium such as a CD-ROM.

Here, each of the above-described embodiments may be understood as below.

The server device 40 according to the present disclosure includes the device information acquisition unit 41 that acquires the device information on the air conditioner 10, the space information acquisition unit 42 that acquires the space information on the target space 100 where the air conditioner 10 is installed, the environment information acquisition unit 43 that acquires the environment information including at least a temperature at the measurement position in the target space, the estimation unit 44 that estimates an environment including at least a temperature at a specific position different from the measurement position in the target space based on the device information, the space information, and the environment information, and the presentation unit 45 that presents, based on estimation by the estimation unit 44, a range of an environment including a temperature adjustable by the air conditioner 10 at the specific position and/or a spatial range in the target space adjustable to a predetermined environment including a temperature by the air conditioner 10. In this case, the user may know the adjustable environment range and the spatial range of the predetermined space to be adjusted by the air conditioner 10.

Here, examples of the environment may include information on air qualities such as temperature, humidity, carbon dioxide, and odor.

Further, the space information acquisition unit 42 acquires the space information including information on the size of the target space 100 and information on the arrangement of the air conditioner 10 in the target space 100. In this case, it is possible to perform highly accurate estimation that reflects the size of the target space 100 and the arrangement of the air conditioner 10 in the target space 100.

Further, the space information acquisition unit 42 acquires the space information including information on an object that is different from the air conditioner 10 and that affects a temperature environment in the target space. In this case, it is possible to estimate the temperature environment with higher accuracy by reflecting the information on the object that affects the environment.

Examples of the object that affect the temperature environment may include heat generating furniture and fixtures such as the personal computer 111, the monitor 112, the printer 113, and the server rack 114, non-heat generating furniture and fixtures such as the desk 115, the bookshelf 116, and the partition 117, and window fixtures such as curtains and blinds.

Further, the presentation unit 45 presents information in the vertical direction and/or the horizontal direction of the target space 100. In this case, it is possible to present, to the user, the range of an environment or the spatial range that is different individually in the vertical direction and/or the horizontal direction in the target space 100.

Here, the information at different heights in the vertical direction may be preferably presented in accordance with the position of a part where the user feels for example the temperature, such as the feet of the user or the head of the user.

Further, the presentation unit 45 displays information on the range of an environment including at least a temperature at the specific position adjustable by the air conditioner 10 so as to be superimposed on the image representing the target space 100. In this case, the information on the range of the environment is superimposed on, for example, the plan view 51 or the side view 61 indicating the target space 100, and thus it is possible for the user to more easily know the range of the environment.

Here, examples of the image representing the target space 100 may include a plan view and a side view of the target space 100, a photographic image obtained by photographing the target space 100, and a schematic view of the target space 100.

Further, the presentation unit 45 presents a range of the environment at a plurality of the specific positions. In this case, for example, compared to a case where the range of the environment at a single specific position is presented, the user may know the information on the adjustable range of the environment in the target space 100 in detail.

Furthermore, the presentation unit 45 presents time information about the time it takes for the environment at the specific position to become a predetermined environment. In this case, the user may know the time it takes to become the predetermined environment.

Further, while maintaining an environment at a first specific position among the specific positions, the presentation unit 45 presents a range of an environment adjustable at a second specific position different from the first specific position. In this case, for example, while maintaining the set temperature desired by the user at the first specific position, the range of the environment that may be set by another user at the second specific position may be indicated to another user.

Further, the air conditioning system 1 according to the present disclosure includes the air conditioner 10 that adjusts at least a temperature in the target space 100, the device information acquisition unit 41 that acquires device information on the air conditioner 10, the space information acquisition unit 42 that acquires space information on the target space 100, the environment information acquisition unit 43 that acquires environment information including at least a temperature at a measurement position in the target space 100, the estimation unit 44 that estimates an environment including at least a temperature at a specific position different from the measurement position in the target space 100 based on the device information, the space information, and the environment information, the presentation unit 45 that presents, based on estimation by the estimation unit 44, a range of an environment including a temperature adjustable by the air conditioner 10 at the specific position and/or a spatial range in the target space 100 adjustable to a predetermined environment including a temperature by the air conditioner 10, the setting reception unit 46 that receives, from a user, setting information on an environment including a temperature at a predetermined position in the target space 100, and the control information generation unit 47 that generates control information for controlling the air conditioner 10 in accordance with the setting information received by the setting reception unit 46. In this case, the user may know the adjustable environment range and the spatial range of the predetermined space to be adjusted by the air conditioner 10.

Here, for example, various functions of the device information acquisition unit 41, the space information acquisition unit 42, the environment information acquisition unit 43, the estimation unit 44, the presentation unit 45, the setting reception unit 46, and the control information generation unit 47 are not always performed by only the server device 40. Some or all of these functions may be performed by for example the information terminal device 30. In this case, the information terminal device 30 functions as an example of an information processing device.

Furthermore, each of the configurations described above is not limited to each of the above-described embodiment and may be changed without departing from the spirit. In other words, it is understood that various changes may be made to forms and details without departing from the spirit and scope of the claims.

In addition to the configurations described above, a part of each configuration described above may be omitted, or other functions may be added to each configuration described above.

REFERENCE SIGNS LIST

1 Air conditioning system, 10 Air conditioner, 20 Environment sensor, 30 Information terminal device, 40 Server device, 41 Device information acquisition unit, 42 Space information acquisition unit, 43 Environment information acquisition unit, 44 Estimation unit, 45 Presentation unit, 46 Setting reception unit, 47 Control information generation unit, 50 Reception screen, 60 Presentation screen, 63 Current state temperature information, 64 Adjustable range information, 70 Setting screen, 80 Presentation screen, 90 Presentation screen, 100 Target space

The invention claimed is:

1. An information processing device comprising:

memory storing an information processing program;

a processor configured to execute the information processing program to:

acquire device information on an air conditioner;

acquire space information on a target space where the air conditioner is installed;

acquire environment information including at least a temperature at a measurement position in the target space;

estimate an environment including at least a temperature at a specific position different from the measurement position in the target space based on the device information, the space information, and the environment information; and present a range of an environment including a temperature at the specific position which is estimated by the estimation of the environment to be adjustable by the air conditioner and/or a spatial range in the target space which is estimated by the estimation of the environment to be adjustable to a predetermined environment including a temperature by the air conditioner.

2. The information processing device according to claim 1, wherein the processor acquires the space information including information on a size of the target space and information on an arrangement of the air conditioner in the target space.

3. The information processing device according to claim 1, wherein the processor acquires the space information including information on an object that is different from the air conditioner and that affects a temperature environment in the target space.

4. The information processing device according to claim 1, wherein the processor presents information in a vertical direction and/or a horizontal direction of the target space.

5. The information processing device according to claim 1, wherein the processor displays information on a range of an environment including at least a temperature at the specific position adjustable by the air conditioner so as to be superimposed on an image representing the target space.

6. The information processing device according to claim 2, wherein the processor displays information on a range of an environment including at least a temperature at the specific position adjustable by the air conditioner so as to be superimposed on an image representing the target space.

7. The information processing device according to claim 3, wherein the processor displays information on a range of an environment including at least a temperature at the specific position adjustable by the air conditioner so as to be superimposed on an image representing the target space.

8. The information processing device according to claim 4, wherein the processor displays information on a range of an environment including at least a temperature at the specific position adjustable by the air conditioner so as to be superimposed on an image representing the target space.

9. The information processing device according to claim 1, wherein the processor presents a range of the environment at a plurality of the specific positions.

10. The information processing device according to claim 1, wherein the processor presents time information about a time it takes for the environment at the specific position to become a predetermined environment.

11. The information processing device according to claim 1, wherein, while maintaining an environment at a first specific position among the specific positions, the processor presents a range of an environment adjustable at a second specific position different from the first specific position.

12. An air conditioning system comprising:

an air conditioner that adjusts at least a temperature in a target space;

memory storing an information processing program;

a processor configured to execute the information processing program to:

acquire device information on the air conditioner;

acquire space information on the target space;

acquire environment information including at least a temperature at a measurement position in the target space;

estimate an environment including at least a temperature at a specific position different from the measurement position in the target space based on the device information, the space information, and the environment information;

present a range of an environment including a temperature at the specific position which is estimated by the estimation of the environment to be adjustable by the air conditioner and/or a spatial range in the target space which is estimated by the estimation of the environment to be adjustable to a predetermined environment including a temperature by the air conditioner;

receive, from a user, setting information on an environment including a temperature at a predetermined position in the target space; and generate control information for controlling the air conditioner in accordance with the received setting information received by the setting reception unit.

13. A non-transitory computer readable medium storing a program causing a computer to perform:

a function of acquiring device information on an air conditioner;

a function of acquiring space information on a target space in which the air conditioner is installed;

a function of acquiring environment information including at least a temperature at a measurement position in the target space;

a function of estimating an environment including at least a temperature at a specific position different from the measurement position in the target space based on the device information, the space information, and the environment information; and a function of presenting a range of an environment including a temperature at the specific position which is estimated by the function of estimating to be adjustable by the air conditioner and/or a spatial range in the target space which is estimated by the function of estimating to be adjustable to a predetermined environment including a temperature by the air conditioner.

* * * * *